US011590050B2

(12) United States Patent
Shin

(10) Patent No.: US 11,590,050 B2
(45) Date of Patent: Feb. 28, 2023

(54) SELF-MASSAGE DEVICE

(71) Applicant: Bong Hang Shin, Honolulu, HI (US)

(72) Inventor: Bong Hang Shin, Honolulu, HI (US)

( * ) Notice: Subject to any disclaimer, the term of this patent is extended or adjusted under 35 U.S.C. 154(b) by 497 days.

(21) Appl. No.: 16/874,513

(22) Filed: May 14, 2020

(65) Prior Publication Data

US 2020/0368102 A1 Nov. 26, 2020

Related U.S. Application Data

(60) Provisional application No. 62/850,435, filed on May 20, 2019.

(51) Int. Cl.
*A61H 15/00* (2006.01)

(52) U.S. Cl.
CPC ..... *A61H 15/00* (2013.01); *A61H 2015/005* (2013.01); *A61H 2201/0149* (2013.01); *A61H 2201/1253* (2013.01); *A61H 2203/0431* (2013.01)

(58) Field of Classification Search
CPC ..... A61H 15/00; A61H 2015/005; A61H 2201/1253; A61H 2201/0119; A61H 2201/0123; A61H 2201/0126; A61H 2201/0149; A61H 2203/0431; A47F 5/0807; A47F 5/0815; A47F 5/0823; A47F 7/0028
See application file for complete search history.

(56) References Cited

U.S. PATENT DOCUMENTS

| | | | | |
|---|---|---|---|---|
| 1,609,544 | A | 12/1926 | Hamersley et al. | |
| 1,688,764 | A | 10/1928 | Trankowski et al. | |
| 4,345,757 | A | 8/1982 | Lo Voi | |
| 5,776,085 | A * | 7/1998 | Stone | A61H 37/00 601/99 |
| 6,135,972 | A | 10/2000 | Kuo | |
| 7,217,248 | B2 | 5/2007 | Lin | |
| 7,320,668 | B1 * | 1/2008 | Warder | A61H 7/001 601/136 |
| 9,649,246 | B1 | 5/2017 | Johnson | |
| 9,849,065 | B1 * | 12/2017 | Kozlevcar | A61H 39/04 |
| 10,052,255 | B2 | 8/2018 | Harvel | |
| 2002/0133104 | A1 | 9/2002 | Bedgood | |
| 2005/0045779 | A1 * | 3/2005 | Nan | F16M 11/14 248/133 |
| 2010/0121235 | A1 * | 5/2010 | Sasano | A61H 7/001 601/134 |
| 2011/0313333 | A1 | 12/2011 | Nicholson | |
| 2012/0028765 | A1 * | 2/2012 | Morin | A63B 21/00047 482/91 |

(Continued)

*Primary Examiner* — Colin W Stuart
*Assistant Examiner* — Douglas Y Sul
(74) *Attorney, Agent, or Firm* — Knobbe Martens Olson & Bear, LLP

(57) ABSTRACT

A massage device comprising a base portion having a first main surface, a plurality of support elements arranged in an array pattern about a first main surface of the base portion and extending through the first main surface thereof, and a massage member supportable by any one of the plurality of support elements, wherein the massage device is configured such that a user can rotate the massage member about an end portion of the massage member supported by the desired support element so as to exert a force on the user's body, thereby effecting a massaging of a portion of the user's body.

17 Claims, 10 Drawing Sheets

(56) References Cited

U.S. PATENT DOCUMENTS

| | | | | |
|---|---|---|---|---|
| 2013/0066245 | A1 | 3/2013 | Dagan | |
| 2015/0245977 | A1 | 9/2015 | Sungarian et al. | |
| 2015/0374576 | A1* | 12/2015 | Dagan | A61H 7/003 601/119 |
| 2016/0058656 | A1* | 3/2016 | Harvel | A61H 15/00 601/122 |
| 2016/0151235 | A1 | 6/2016 | Yu et al. | |
| 2016/0166465 | A1 | 6/2016 | Marson | |
| 2017/0360204 | A1* | 12/2017 | Ellis | A47C 7/425 |

* cited by examiner

SELF-MASSAGE DEVICE

PRIORITY CLAIM AND INCORPORATION BY REFERENCE

The present application claims priority from U.S. Patent Application No. 62/850,435 filed on May 20, 2019, titled SELF-MASSAGE DEVICE, the contents of which is hereby incorporated by reference herein in its entirety as if fully set forth herein. The benefit of priority is claimed under the appropriate legal basis including, without limitation, under 35 U.S.C. § 119(e). Any and all applications for which a foreign or domestic priority claim is identified in the Application Data Sheet as filed with the present application are hereby incorporated by reference herein in their entirety and made a part of this specification.

BACKGROUND OF THE DISCLOSURE

Field of the Disclosure

The disclosure generally relates to massage devices, in particular, manually operated massage devices.

Description of the Related Art

Conventional massage apparatus such as massage balls, massage chairs, massage rods with massaging balls, and "cane" massagers are either hard to use without someone's help, are dependent upon the user's physical strength and coordination, or just are not effective at alleviating pain in aching muscles and soft tissue of the shoulders, neck, and back. Automated massage chairs are very expensive, hard or impossible to control and are unable to reach critical sections of the shoulder, neck and back where people often experience pain such as the top and front of the trapezius muscles (between shoulders and neck), teres major and teres minor muscles (back part of armpit), and latimus dorsi (under armpit).

SUMMARY OF SOME EXEMPLIFYING EMBODIMENTS

A need exists for a massage device that is easy to use by an individual user and is effective in exerting the massage forces needed to alleviate pain in aching muscles and soft tissue of the shoulders, neck, back, and other body parts.

Some embodiments of the massage devices and/or methods disclosed herein have a base member having a first main surface, a plurality of support elements in communication with the base member and extending through the first main surface, and a massage member comprising one or more massage elements positioned about a length of the massage member. In any embodiments, the plurality of support elements can be arranged in an array or grid arrangement (for example, having rows and columns, or radially arranged support elements arranged in concentric circles) about the first main surface of the base member. An end portion of the massage member can be configured to be removably supported by any of the plurality of receiving elements (also referred to herein as support elements) so that the massage member is free to rotate about the end portion of the massage member. Also, in any embodiments, the massage device can be configured such that a user can rotate the massage member about an end portion of the massage member supported by the desired support element so as to exert a force on the user's body, thereby effecting a massaging of a portion of the user's body.

Some embodiments of the massage devices and/or methods disclosed herein can have a base portion having a first main surface, a plurality of support elements coupled with the base portion or integral with the base portion, and a massage member having at least one massage element coupled or integrally formed therewith.

Some embodiments of the massage devices and/or methods disclosed herein can have a seat having a support portion (which can, in some but not all embodiments, serve as a back support) having a first main surface, a plurality of support elements coupled with the support portion, and a massage member comprising one or more massage elements positioned about a length of the massage member. In any embodiments, each support element can have an opening that extends through the first main surface of the support portion.

Some embodiments of the massage devices and/or methods of using any of the massage device embodiments disclosed herein can include positioning a base portion so that a first surface of the base portion is in an approximately upright orientation (which can be, but is not required to be, an approximately vertical orientation), inserting a first end portion of a massage member into a first support element of a plurality of support elements formed in a base portion, each support element being configured to support an end portion of the massage member, and moving or rotating the massage member about the first end portion of the massage member and the first support element by moving a distal portion of the massage member in any direction normal to a longitudinal axis of the massage member, thereby forcing a portion of the massage member against a first portion of the user's body so that at least a portion of the massage member exerts a force on the first portion of the user's body to effect a massaging of the first portion of the user's body. In any embodiments, the massage devices and/or methods of using any of the massage device embodiments disclosed herein can further include removing the first end portion of the massage member from the first support element, inserting the first end portion of the massage member into a second support element of the plurality of support elements formed in the base portion, and moving or rotating the massage member about the first end portion of the massage member and the second support element by moving a distal portion of the massage member in any direction normal to the longitudinal axis of the massage member, thereby forcing a portion of the massage member against a second portion of the user's body so that at least a portion of the massage member exerts a force on the second portion of the user's body to effect a massaging of the second portion of the user's body. In any embodiments, the method can include securing the base portion to the backrest of a chair and/or sitting in the chair.

Any embodiments of the devices, systems, and methods disclosed herein can include, in additional embodiments, one or more of the following features, components, and/or details, in any combination with any of the other features, components, and/or details of any other embodiments disclosed herein: wherein the plurality of support elements are positioned in a grid-like arrangement about one or more surfaces (or two or more surfaces) of the base portion comprising two or more rows and two or more columns of support elements; wherein the plurality of support elements are positioned in a grid-like arrangement about the first main surface of the base portion comprising two or more rows and two or more columns of support elements; wherein the plurality of support elements are each configured to bias the end portion of the massage member to remain coupled with the selected receiving element; wherein the plurality of support elements have a main cavity portion and a constricted portion, wherein the constricted portion is configured to bias the end portion of the massage member to remain positioned within the main cavity portion; wherein the massage member is substantially rigid at least along a length thereof; wherein the base portion can be positioned in an approximately vertical orientation, an approximately horizontal orientation, or any desired orientation; wherein the device is configured such that the massage member can be rotated within the support element within a predetermined range; wherein the predetermined range is approximately 45 degrees or more; wherein the predetermined range is approximately 90 degrees or more; wherein the predetermined range is up to approximately 180 degrees; wherein the predetermined range is from approximately 90 degrees to at least approximately 160 degrees; wherein the plurality of support elements are each configured to support the massage member such that massage member is free to rotate about the end portion of the massage member within a range of approximately 90 degrees; wherein the base portion is made of a semi-rigid foam material; wherein the massage member comprises a plurality of spherically shaped massage elements arranged about a length of the massage member; and/or wherein the massage member comprises a spherically shaped end portion configured to be selectively supported by any one of the plurality of support elements.

Any embodiments of the devices, systems, and methods disclosed herein can include, in additional embodiments, one or more of the following features, components, and/or details, in any combination with any of the other features, components, and/or details of any other embodiments disclosed herein: wherein the support elements are configured to extend through the first main surface into a cavity portion of the base member in an operable state; wherein the massage member comprises a plurality of massage elements positioned about at least a portion of a length of the massage member; wherein each of the plurality of massage elements has a spherical shape; wherein the massage member comprises a plurality of massage elements positioned adjacent to one another about at least a portion of the length of the massage member; wherein an end portion of the massage member is configured to be removably supported by any of the plurality of support elements so that the massage member can be selectively supported and removed from any of the plurality of support elements without a use of any tools or fasteners; wherein the device is configured such that an end portion of the massage member is coupleable with any of the support elements by only axially advancing the end portion into a desired support element; wherein the support elements are enclosures having sides and a closed end portion; wherein the support elements are each configured to receive and support an end portion of the massage member without the use of any fasteners; wherein an opening to the support element has a smaller cross-sectional size as compared to any other portion of the support element; wherein an opening to the support element has a smaller cross-sectional size as compared to a cavity or internal portion of the support element; wherein the base portion is configured to be strapped to a back portion of a chair; wherein an end portion of the massage member has a spherical shape; wherein the plurality of support elements are arranged in an array about the first main surface of the backrest; wherein an end portion of the massage member is configured to be removably supported by any of the plurality of support elements so that the massage member is free to rotate in a plurality of angular directions relative to the support element that the end portion of the massage member is supported by; and/or wherein the massage device is configured such that a user can rotate the massage member about an end portion of the massage member supported by the desired support element so as to force the massage member against a surface of the user's body, thereby effecting a massaging of a portion of the user's body.

Any embodiments of the devices, systems, and methods disclosed herein can include, in additional embodiments, one or more of the following features, components, and/or details, in any combination with any of the other features, components, and/or details of any other embodiments disclosed herein: wherein the plurality of support elements are arranged in a grid like pattern about the first main surface and/or other surface or surfaces of the base portion; wherein an end portion of the massage member is configured to be removably supported by any of the plurality of support elements so that the massage member is free to rotate in a plurality of angular directions relative to the support element that the end portion of the massage member is supported by; and/or wherein the device is configured such that a user can rotate the massage member in the plurality of angular directions relative to the support element that the end portion of the massage member is supported by to force the massage member against a portion of the user's body to massage a portion of the user's body with the device.

Any embodiments of the devices, systems, and methods disclosed herein can include, in additional embodiments, one or more of the following features, components, and/or details, in any combination with any of the other features, components, and/or details of any other embodiments disclosed herein: wherein the plurality of support elements have a main cavity portion and a constricted portion, wherein the constricted portion is configured to bias the end portion of the massage member to remain in communication with the selected support element; wherein the base member can be positioned in an approximately vertical orientation, an approximately horizontal orientation, or any desired orientation; wherein the plurality of support elements are each configured to support the massage member such that massage member is free to rotate about the end portion of the massage member within a range of approximately 90 degrees, or within a range of approximately 160 degrees, or within a range of approximately 180 degrees; wherein the base member is made of a semi-rigid foam material; wherein the massage member comprises a plurality of spherically shaped massage elements arranged about a length of the massage member; and/or wherein the massage member comprises a spherically shaped end portion configured to be selectively supported by any one of the plurality of receiving elements.

Some embodiments disclosed herein are directed to a method of massaging one's own body with a massage device, comprising positioning a base member so that a first surface of the base member is in a vertical orientation, inserting a proximal end portion of a substantially rigid massage member into a first socket of a plurality of sockets formed in a base member, each socket being configured to support an end portion of a massage member, and/or moving or rotating the massage member about the proximal end portion of the massage member and the first socket by moving a distal portion of the massage member in any direction normal to a longitudinal axis of the massage member, thereby forcing a portion of the massage member against a first portion of the user's body so that at least a portion of the massage member exerts a force on the first portion of the user's body to effect a massaging of the first portion of the user's body. Any embodiments can further comprise rotating the massage member about the proximal end portion of the massage member and the second socket by moving a distal portion of the massage member in any direction normal to a longitudinal axis of the massage member, thereby forcing a portion of the massage member against a second portion of the user's body so that at least a portion of the massage member exerts a force on the second portion of the user's body to effect a massaging of the second portion of the user's body. Any embodiments can further comprise removing the proximal end portion of the massage member from the first socket and inserting the proximal end portion of the massage member into a second socket of the plurality of sockets formed in the base member.

BRIEF DESCRIPTION OF THE DRAWINGS

Embodiments of the present disclosure will now be described hereinafter, by way of example only, with reference to the accompanying drawings in which.

DETAILED DESCRIPTION OF THE PREFERRED EMBODIMENT

Figure 1:
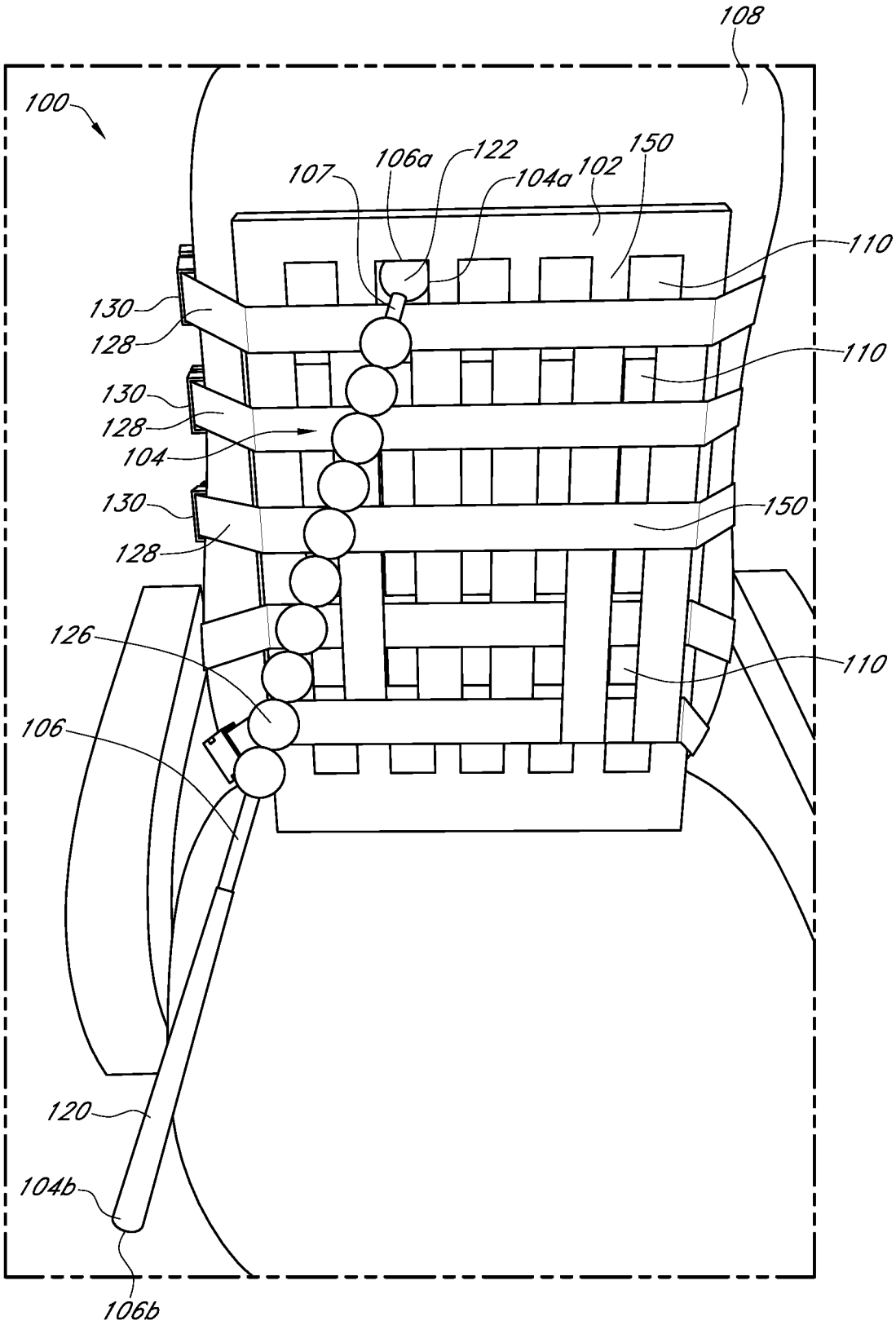
FIG. 1 is a first perspective view of an embodiment of a massage device, wherein the support member of the massage device is coupled with a backrest of a chair and showing an embodiment of a massage member in a first location.

Disclosed herein are various embodiments of a massage device that can be used to administer a massage to any desired portion of a user's body. It should be noted that any of the embodiments disclosed herein can include any of the features, components, and other details of any of the other embodiments disclosed herein (including any of those features, components, and other details disclosed above) in combination with or in the alternative to any of the features, components, and other details explicitly described herein to form new embodiments.

In any embodiments, the massage device can be used for effecting a massage of any portion of a user's body without the assistance of another person. Alternatively, any of the massage device embodiments disclosed herein can be used by a companion, care giver, or massage professional to administer a massage to another. Any embodiments of the massage device 100 disclosed herein can have a base member 102 (also referred to herein as a support portion or support member), a massage member 104, which can have a rod, wand, shaft or other substantially stiff lengthwise member 106 (referred to herein as a shaft member) that can support one or a plurality of massage elements 126 positioned along the length of the shaft member 106. In some embodiments, the massage member 106 can be substantially rigid along a length thereof. The massage member 104 can also have an anchoring element 122 at a first end portion 106*a* (which can be referred to as a proximal end portion) of the shaft member 106. The massage member 104 can have a handle 120 positioned at a distal end portion 106*b* of the massage member 104, and one or a plurality of massage elements 126 along at least a portion of the length of the shaft member 106. Alternatively, in any embodiments disclosed herein, the massage member 104 can have a hinged handle (not shown), a curved handle, or any other configuration of a handle to permit a user to adjust the orientation or position of his or her hand or the massage member 104. The handle can be configured to lock in any of a plurality of positions or orientations to allow the user to adjust his or her grip on the massage member.

In any embodiments, the massage elements 126 can have a spherical shape and can be independently rollable. In any embodiments, one or more of the massage elements 126 can have a non-spherical shape, including a wavy shape, a polygonal shape such as a hexagonal shape, an octagonal shape, or otherwise, with smooth or rounded edges or corners. The massage elements can be supported by the shaft member 106 along a length of the shaft member 126 and can be in a fixed axial position, or can be movable along a portion of the length of the shaft member 126. In the illustrated embodiments, the massage elements can be made from golf balls or other substantially rigid spherical balls or objects that have a bore hole bored therethrough so that the massage elements can rotate about the shaft 106. In any embodiments, however, the massage elements 126 can have any desired shape and/or features, including having dimples, protrusions, ridges, dimples, soft spikes, flat surfaces, points, and/or any other designed features or surface textures thereon, and can be made from plastic, rubber, or any other suitable material. For example and without limitation, the massage elements 126 can have a square shape, hexagonal shape, octagonal shape, or other polygonal shape, having rounded corners or sharp corners, or otherwise. Additionally, in any embodiments, the massage elements 126 can have a grippy surface, a rubber surface, a smooth surface, or otherwise.

Additionally, in any embodiments disclosed herein, the support member 102 can be configured to attach to a chair, a wall, a door, a tree, or any of a range of other suitable support structures that can securely support the support member 102. The support member can be attached to the support structure using one or more straps 128 and one or more tightening mechanisms (for example, without limitation, buckles) 130. Additionally, in any embodiments, ratcheting straps can be used to tightly secure the support member 102 to the support structure. Alternatively, in any embodiments disclosed herein, the support member 102 can be free standing or self-supporting such that the support member 102 does not need to be attached to another structure for support. In any embodiments, the support member 102 can also provide a back rest or cushion for a user.

In the embodiment shown in the figures, the support member 102 can have a plurality of support elements 110 (which can be sockets, receptacles, depressions, or other anchoring components), each of which support elements 110 can be configured to receive an end portion of the massage member 104 to create an anchor point or support for the first end portion 104*a* of the massage member 104. The plurality of support elements 110 can be positioned in any desired embodiment or pattern. For example without limitation, as is illustrated in the figures, the plurality of support elements 110 can be arranged in a grid or array with any desired number of support elements 110 in the horizontal direction in any desired number of support elements 110 and a vertical direction.

For example and without limitation, in any embodiments, the support member 102 can have five receptacles in a horizontal direction, or from three to approximately eight (or, in some embodiments, more than eight) support elements 110 in a horizontal direction, or from four to six support elements 110 in a horizontal direction. Additionally, in any embodiments, the support member 102 can have six receptacles in a vertical direction, or from four to ten support elements 110 in a vertical direction, or from four to six support elements 110 in a vertical direction. Any number of support elements 110 in a horizontal direction can be used with any number of support elements 110 in a vertical direction in any of the ranges disclosed herein. Accordingly, as illustrated, the support member 102 can have five support elements 110 in a horizontal direction and six support elements 110 in a vertical direction. In any other embodiments, the plurality of support elements 110 can be arranged in any desired pattern or array, including one in which the array of support elements 110 has the shape and size similar to the silhouette or the anatomy of an upper body of an adult person. Alternatively, in any embodiments disclosed herein, the support member 102 can be configured to have only one support element 110, or only a single row of support elements 110, or any desired number or configuration of support elements 110.

With reference to FIGS. 4-8, a variety of different positions and massage techniques are illustrated using the massage device 100. As is evident, the user can easily change the angle of the massage member 104 by simply choosing another support element 110 or rotating the anchoring member 122 around within the support element 110 to massage different areas of the body. Additionally, the massage member 104 may be used on its own as a massage bar to massage almost any part of the user's body.

The support member 102 can be used in conjunction with the massage member 104 to create leverage and force to compress and knead soft tissue during the massage. The sockets or support elements 110 can also be used to stabilize the massage member 104 (also referred to herein as a massage rod) in a fixed position in many varying angles to massage the user's neck, shoulders and back while seated in a chair. The massage device 100 can be configured to be easy to use and control so that some embodiments can even be used to gently massage the side and front of the user's neck, platysma, and stemocleidomastoid muscles.

Accordingly, embodiments of the massage device 100 can be configured to allow users to easily control the strength of the massage according to their level of comfort. Additionally, as the user moves the massage member 104 back and forth across soft tissue, the massage elements 126 can exert a force on the muscles that will "knead" the muscles. If additional force is needed or desired, two hands may be used to support the massage member 102. Additionally, the handle portion 120 of the massage member 102 can be placed against a stationary object (armrest or seat) to create stable stationary massage member 104 that users may move their bodies against to affect the massage. The massage member 104 can be positioned to massage soft tissue either against or with the rolling direction of the massage elements 126.

The support member 102 with sockets or support elements 110 can be securely attached to the backrest of a compatible chair with straps 128 or any other suitable fasteners that can extend around the backrest of the chair and/or extend under the seat cushion or seat portion of the chair for additional support and stability. Additionally, in any embodiments, one or more straps 128 or loops can extend around one or more of the legs of the chair for additional stability. Further, though not required, any embodiments of the massage device 100 can have one or more buckles, snaps, or other quick release attachments or fasteners 130 to allow a user to quickly and easily attach the support member 102 to a chair or other support object and/or remove the support member 102 from the chair or support object.

In operation, the anchoring element 122 of the massage member 104 can be inserted into any of the plurality of support elements 110, depending on the area of the body that the user wishes to massage and/or depending on the angle of the massage member 104 that the user desires. With the massage member 104 anchored into one of the sockets or support elements 110, the user can then grasp any portion of the massage member 104, including the handle portion 120 thereof, and rotate the massage member 104 about the end portion 104*a* of the massage member 104 and leverage or force one or more of the massage elements 126 of the massage member 104 against the desired portion of the body that the user wishes to massage. In this manner, the massage device 100 can be used to exert a force against any portion of the body, including the neck, back, shoulder, arms, legs, or otherwise and can be moved continuously on such target areas to effect a massage of the soft tissue. In any embodiments, the support member 102 in the support elements 110 can be sufficiently rigid and robust to permit the user to exert a very high force against the body with the massage member 104. Alternatively, with the massage member 104 anchored into or supported by one of the sockets or support elements 110, the user can lean against the massage member 104 and use his or her body weight against the massage member 104 to effect a massaging force by moving his or her torso against the massage member 104 in a rubbing motion. In another alternate use, the massage member 104 can be anchored into or supported by the support member 102 as described above with the handle 120 or shaft 106 of the massage member 104 held against the armrest or chair seat to create many more massaging angles.

Additionally, in any embodiments disclosed herein, the support member 102 can itself have a substantially rigid backing that can resist against the bending or folding of the support member 102. In such an application, a user may, for example, lean the support member 102 against a wall surface and use the force of the user's body against the support member 102 to maintain the position of the support member 102. Additionally, in any embodiments, the support member 102 can be positioned horizontally on any desired surface, such as but not limited to, a bed, a couch, a floor, or table surface in the user can position his or her body on top of the support member 102 in any desired orientation, including in a supine orientation, lying on the user side, sitting on the support member 102, or otherwise, to affect the massaging of any desired portion of the body by inserting the massage member 104 in any of the desired one or more support elements 110.

Figure 2:
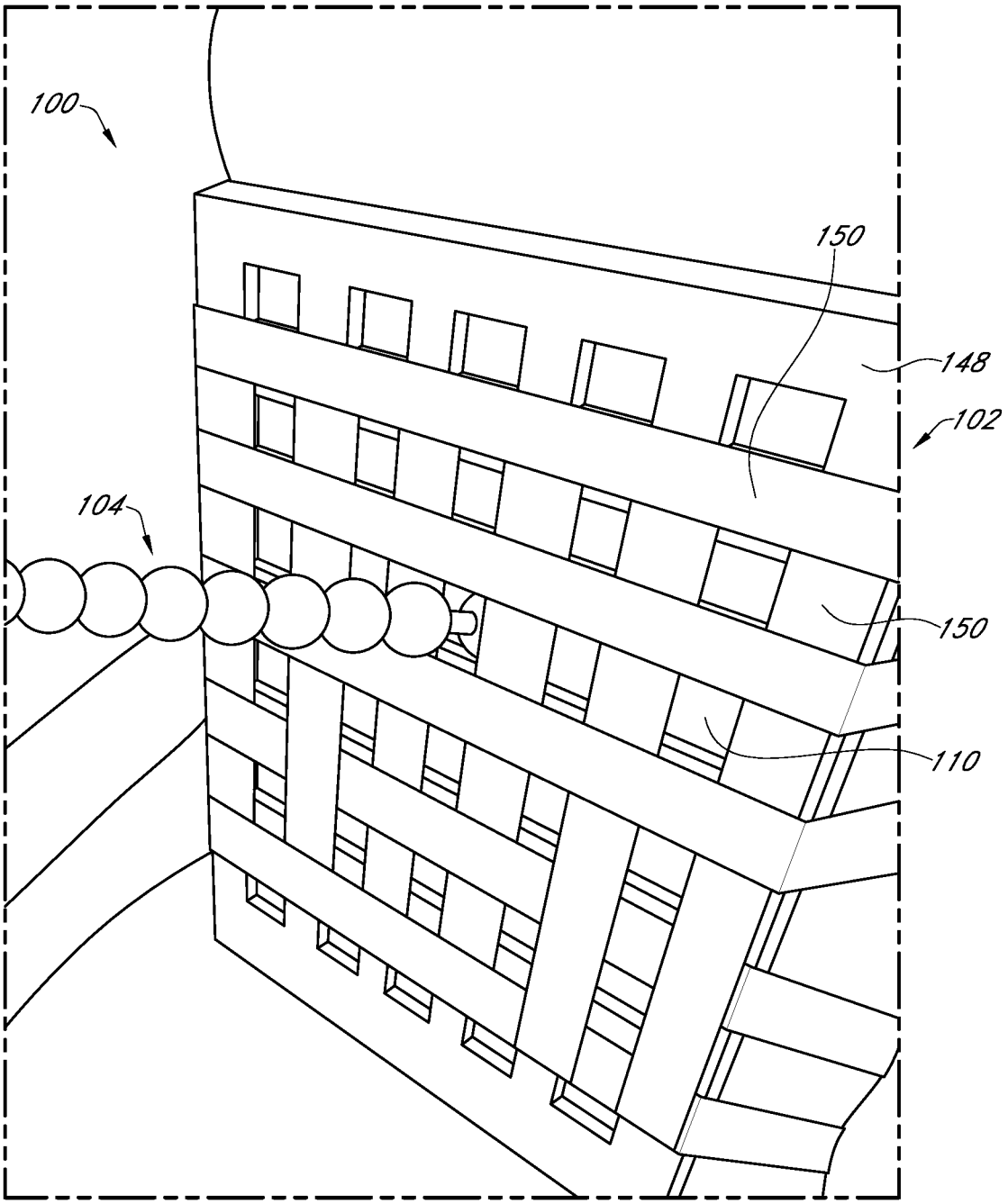
FIG. 2 is another perspective view of a portion of the embodiment of the massage device shown in FIG. 1, showing the embodiment of the massage member of FIG. 1 in a second location.
Figure 3:
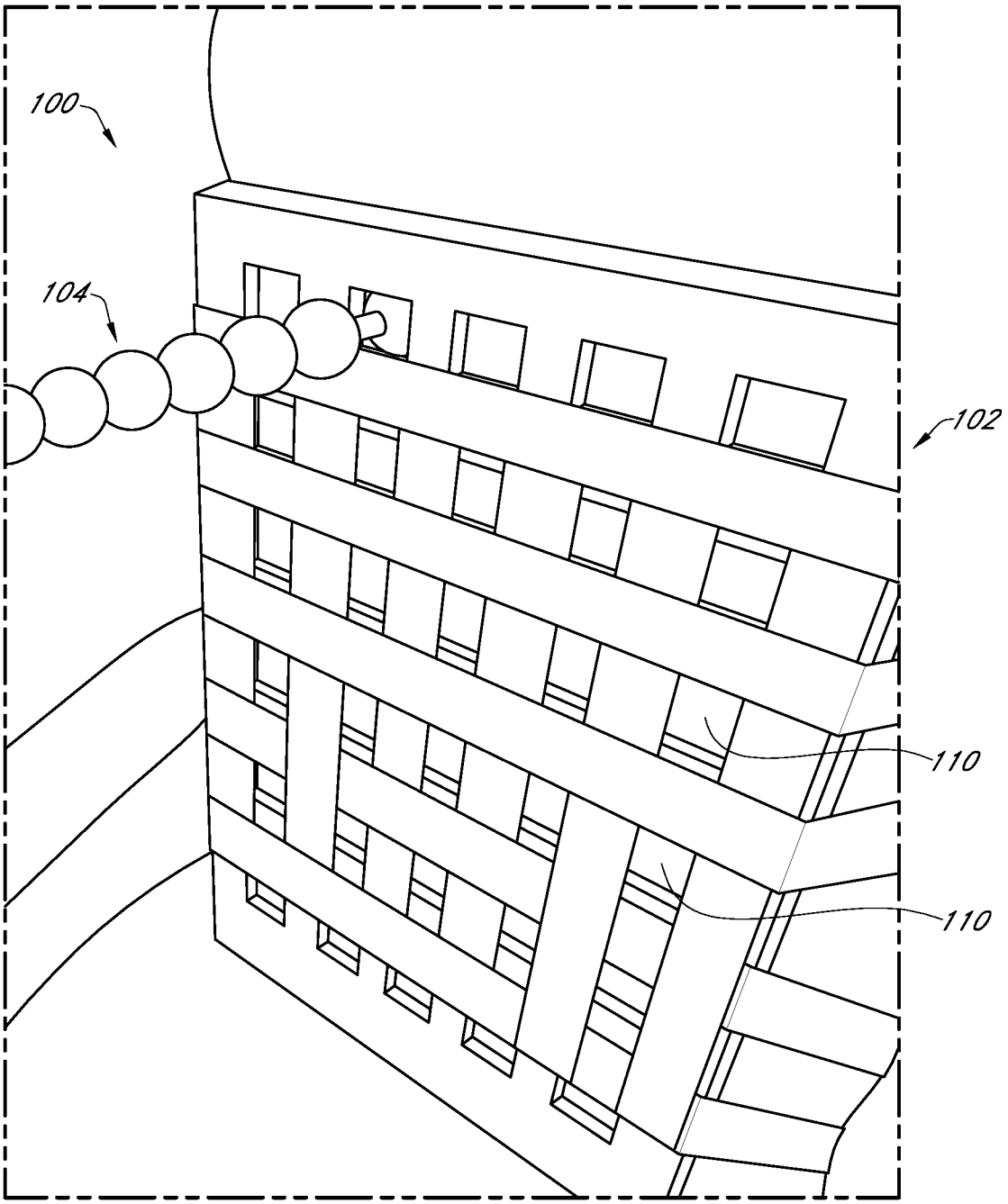
FIG. 3 is another perspective view of a portion of the embodiment of the massage device shown in FIG. 1, showing the embodiment of the massage member of FIG. 1 in a third location.
Figure 4:
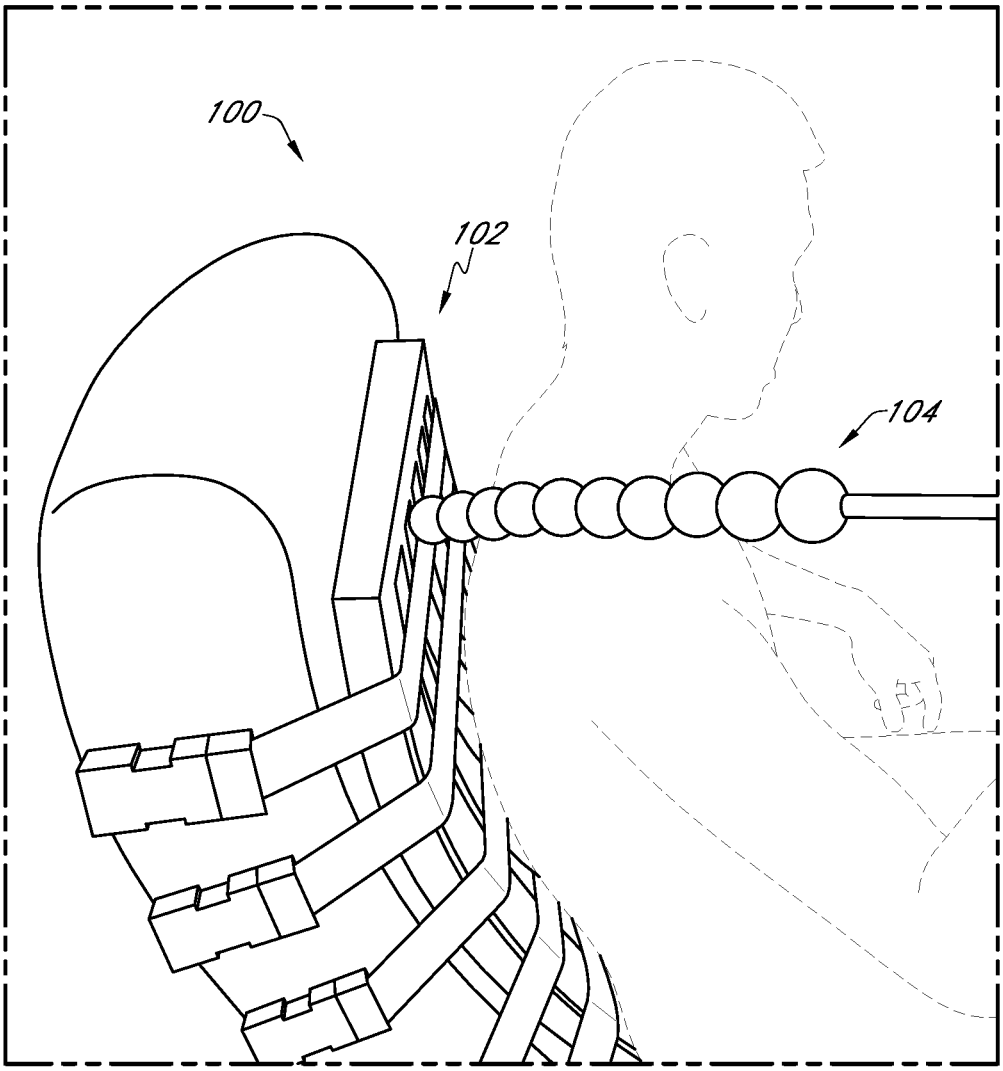
FIG. 4 is a perspective view of the embodiment of the massage device shown in FIG. 1, showing a use of the massage device.
Figure 5:
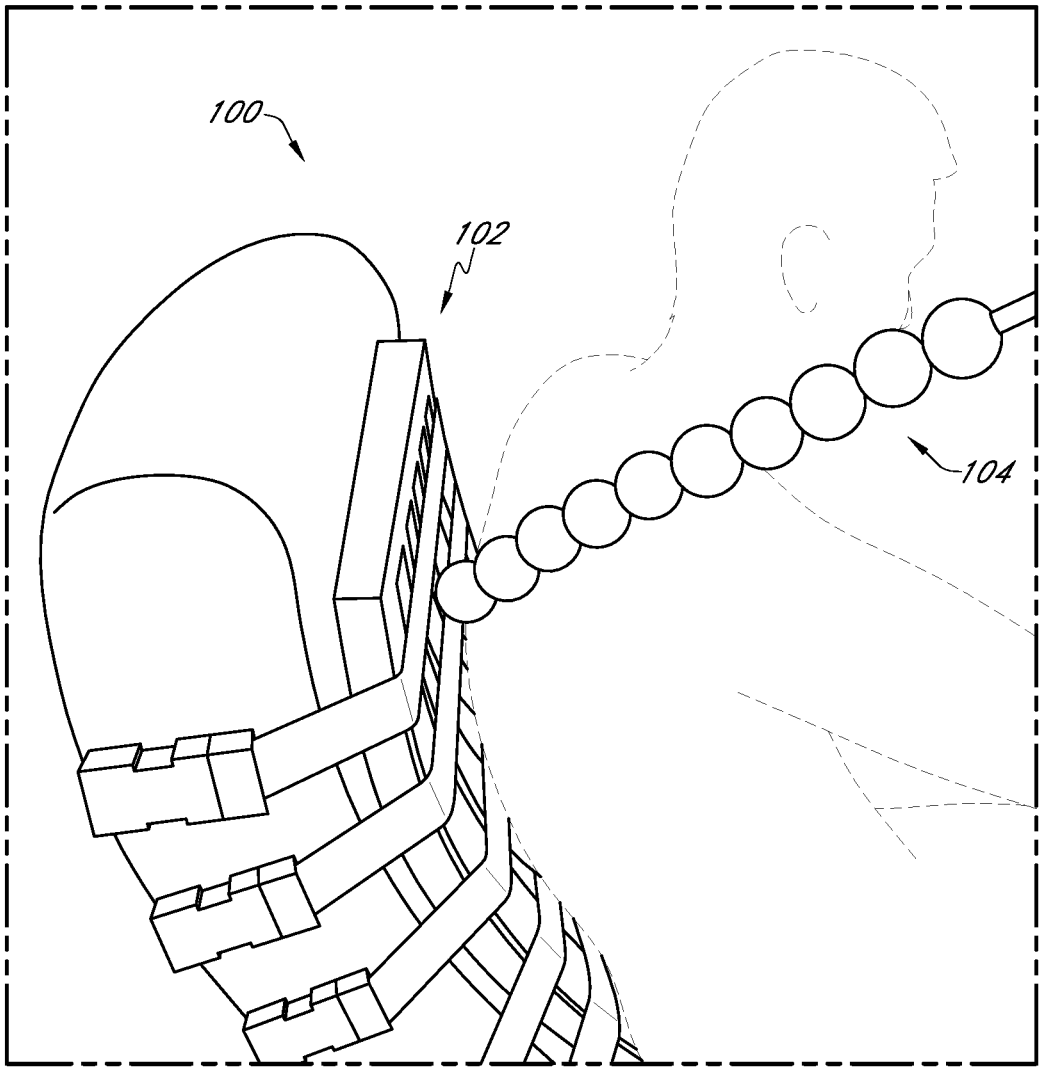
FIG. 5 is another perspective view of the embodiment of the massage device shown in FIG. 1, showing another use of the massage device.
Figure 6:
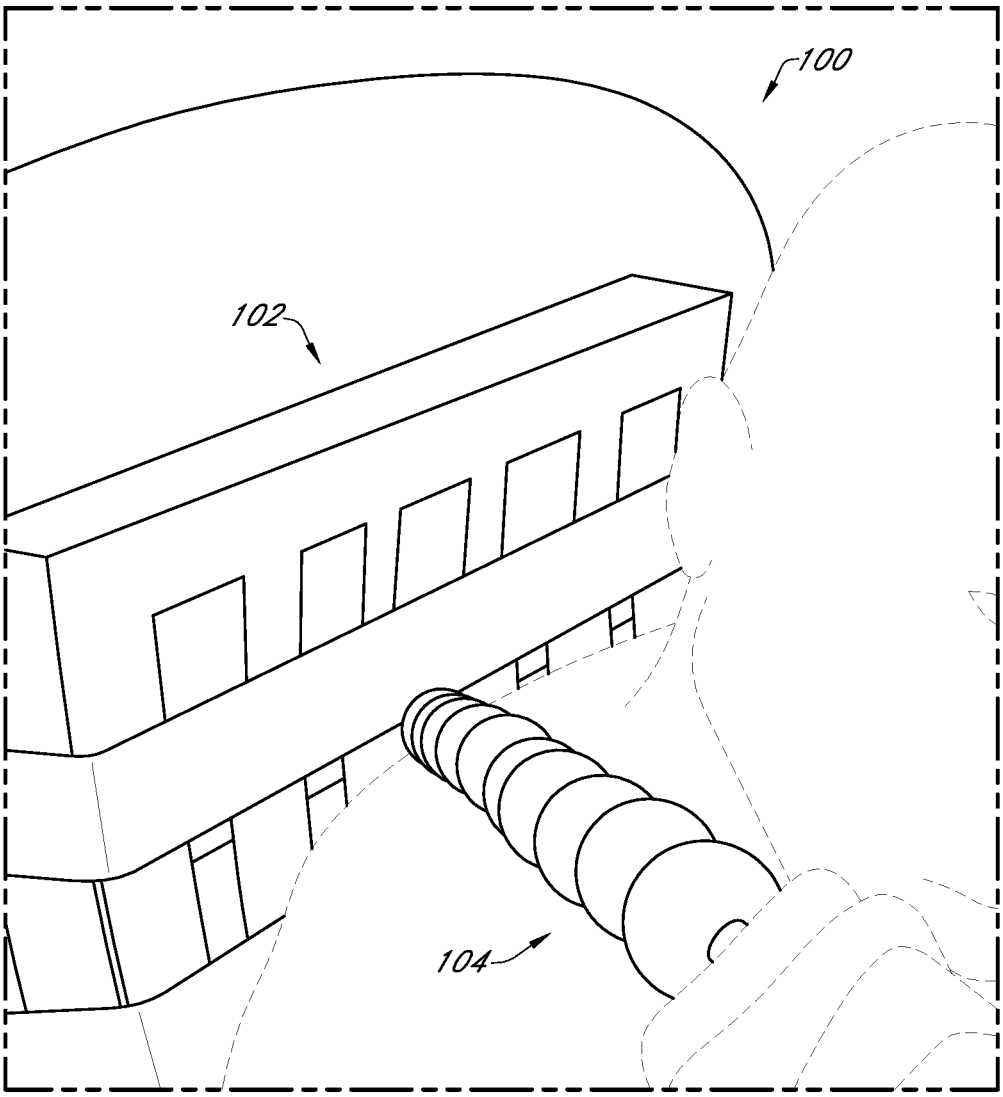
FIG. 6 is another perspective view of the embodiment of the massage device shown in FIG. 1, showing another use of the massage device.
Figure 7:
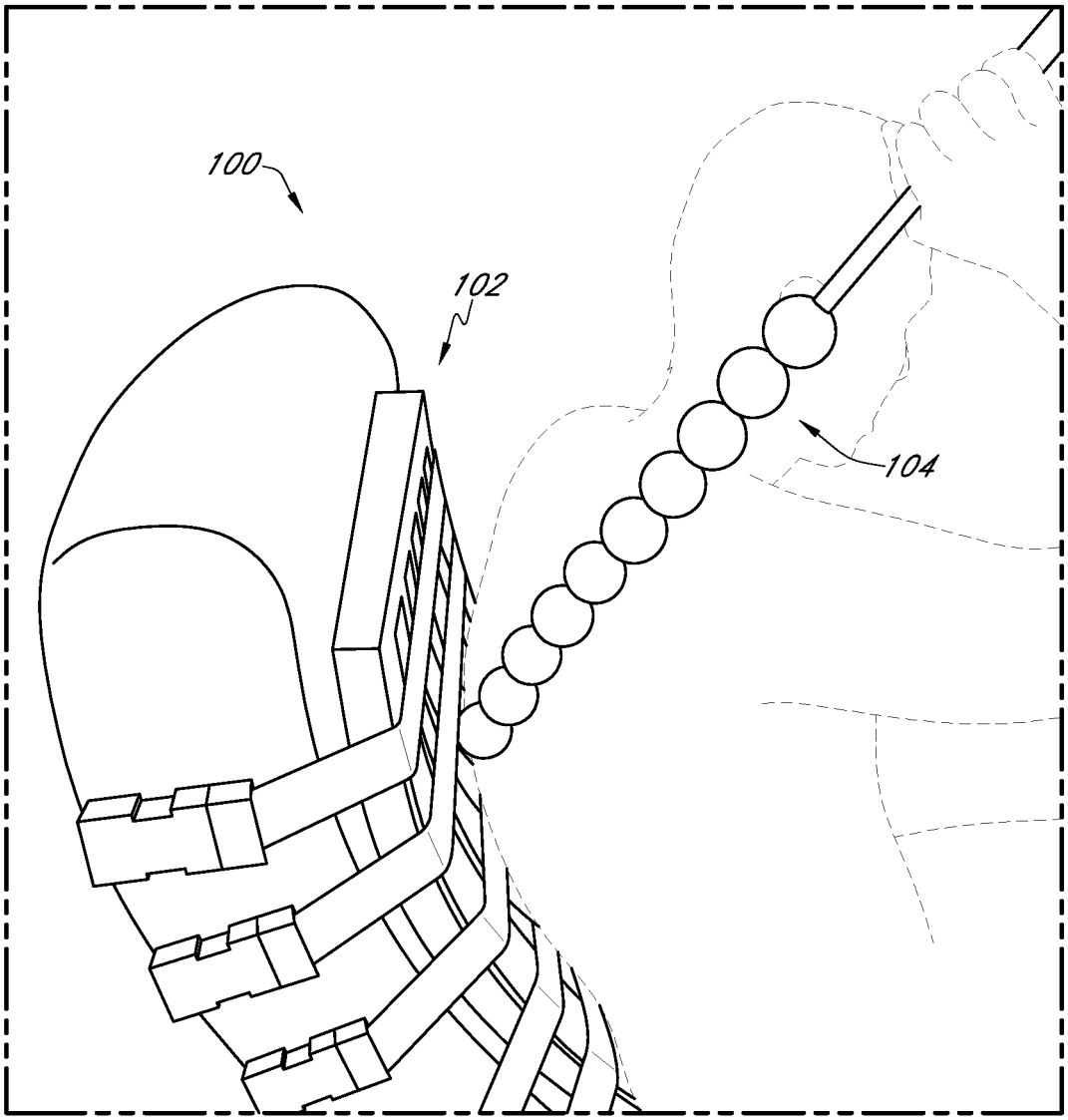
FIG. 7 is another perspective view of the embodiment of the massage device shown in FIG. 1, showing another use of the massage device.
Figure 8:
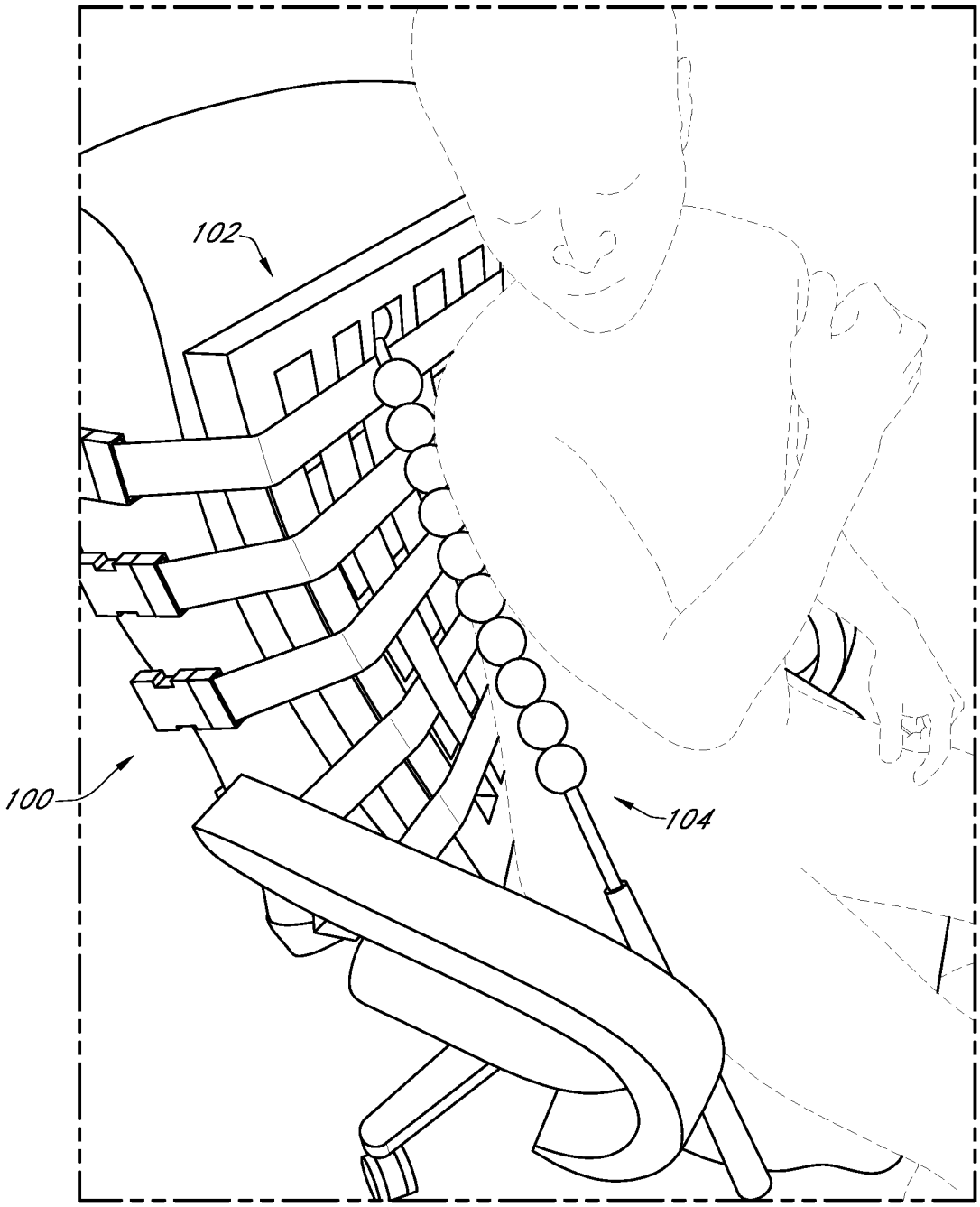
FIG. 8 is another perspective view of the embodiment of the massage device shown in FIG. 1, showing another use of the massage device.

As described, the massage member 104 can be supported in any desired support element 110 to provide a different location and/or orientation of the massage member 104. To illustrate an example of a few different locations of the massage member 102 that are possible, FIG. 2 shows a portion of the embodiment of the massage device 100, showing the embodiment of the massage member 104 in a second location as compared to the position of the massage member 104 shown in FIG. 1. FIG. 3 shows the massage device 100 with the massage member 102 of FIG. 1 in a third location. Additionally, FIGS. 4-8 show a nonlimiting range of different locations that the massage member 102 can be supported in, and a nonlimiting range of different uses of the massage device 100.

Further, in any embodiments, the massage member 104 can be supported in any desired support element 110 and rotated within and relative to the supporting support element within a predetermined range, wherein the predetermined range is approximately 45 degrees or more, or approximately 90 degrees or more, or up to approximately 160 degrees, or up to approximately 180 degrees, or from and to any of the values within the foregoing ranges. Further, in any embodiments disclosed herein, the massage member 104 can be supported by any of the support elements so as to be positioned approximately parallel to a first main surface of the base portion (through which, in some embodiments, the massage member is advanced to engage and couple with the support elements). In other words, for embodiments where the base portion is approximately vertically oriented, the massage member can be supported in an approximately vertical orientation, an approximately horizontal orientation, or any orientation generally parallel with and/or coplanar with the first main surface of the base portion or otherwise against the base portion. In this configuration, the user could rub against the massage member 104 as the massage member 104 is held against the base portion and/or is coupled with any of the support elements.

Additionally, in any embodiments disclosed herein, the support elements 110 can be integrated directly into the back portion of a chair, cot, bed, table (cushioned or otherwise) or other support surface or object so that no additional support member 102 is required to be attached thereto. In these embodiments, a user can simply insert the anchoring element 122 into any of a desired number of support elements 110 that are formed within or coupled with the backrest of a chair, bed, table surface, or otherwise to perform the self-massage. As can be appreciated by one of ordinary skill in the art, the different manners of use the manners of supporting the massage member 104 are virtually unlimited.

Additionally, as will be described in greater detail below, each of the support elements 110 is configured to permit the anchoring element 122 to freely rotate within a desired angular range within the support element 110, while biasing the anchoring elements 122 to remain within the support element 110 to prevent or at least reduce the likelihood of the anchoring element 122 from becoming inadvertently removed from the support element 110. Additionally, with reference to FIG. 9, in any embodiments, the massage member 104 can have a space 107 between the anchoring element 122 and the next closest or adjacent massage element 126 so that the massage member 104 can freely rotate within the support element 110 without the massage elements 126 interfering with the support member 102 when the massage member 104 is rotated to wide angles.

With reference to FIG. 2, any embodiments of the support member 102 can be manufactured from a foam block and nylon strapping. For example, the illustrated embodiment of the support member 102 was manufactured by cutting an array of holes for the support elements 110 in a foam block 148, which can be comprised of a plurality of foam pads. The massage device 100 can optionally or in some embodiments have a cover member 150 that can cover all or a portion of a surface (such as the first main surface) of the support member 102. The cover member 150 can provide additional support, rigidity, strength, and/or aesthetics to the support member 102. This can, in some embodiments, ensure that the massage member 104 can be firmly supported by the support member 102. The cover member 150 (which can also be referred to herein as a cover material) can comprise woven nylon strapping or webbing material, a fabric material, a plastic sheet material, or other suitable material that can, in some embodiments, be made from a single, continuous sheet or strip with openings formed therein that align with the securing elements, or can be made from strips or pieces that are sewn or coupled together in a crisscross or grid like pattern or arrangement to cover the portions of the foam material between the support elements 110 to add additional strength, support, and/or aesthetics to the support member 102. In the illustrated embodiment, the receptacles can have a square shape. However, in any other embodiments, the receptacles can have a round shape, hexagonal shape, or any other polygonal or desired shape.

Additionally, any of the support member 102 embodiments disclosed herein can have any of a number of support elements 110 or other connection interfaces or components or features that can be used to support an end portion of the massage member 104. Further, in any embodiments, the cover member 150 can be used without foam or any other support material behind the cover member 150 such that the cover member provides the support to the anchoring element 122 of the massage member and/or can provide a back support surface against which a user could lean or rest. In this configuration, the anchoring element 122 would be advanceable through the opening 110 into a volume of space or air pocket behind the cover member 150. The cover member 150 could retain the anchoring element 122 in the receptacle 160 or could bias the anchoring element 122 to remain in or engaged with the receptacle.

Figure 10:
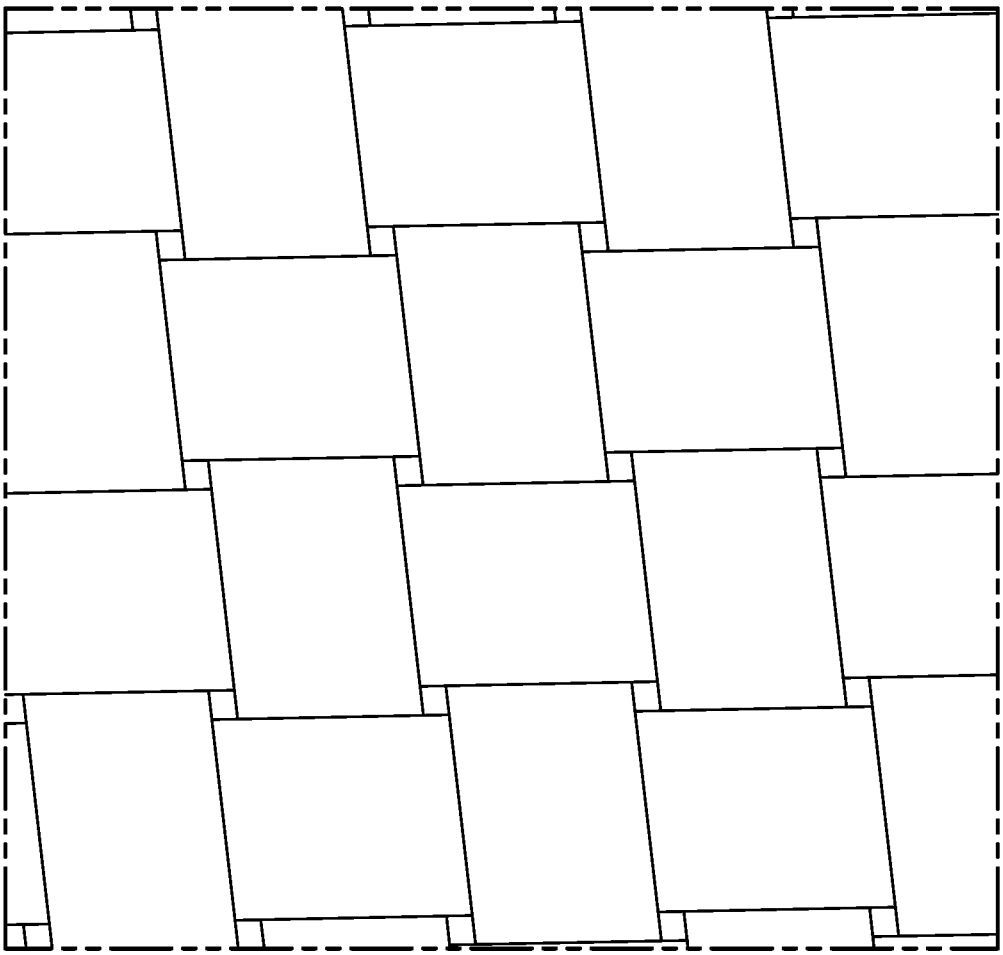
FIG. 10 illustrates another embodiment of a cover member 150.

Optionally, in any embodiments disclosed herein, the support member 102 can have walls or connectors (connectors not shown) in a generally orthogonal orientation to the cover member 120 coupled with the cover member 150. The walls or connectors can provide additional structural strength, support and/or rigidity to each receptacle and the cover member 150. This can inhibit the stretching of the cover member 150 and the support member 102. Additionally, a backing layer could be coupled with the walls or connectors to provide additional strength and support to the support member 102, which would provide an air pocket behind the cover member 120 that the anchoring element 122 can be advanced into and retained by during use. In any embodiments disclosed herein, the cover member 150 can have a plurality of interwoven straps or strips (also referred to as support strips) of material (such as, without limitation, shown in FIG. 10) wherein the support strips alternate in front of and behind adjacent strips in an orthogonal pattern with a plurality of strips in a horizontal orientation and a plurality of strips in a vertical orientation, which can form a weave in which the openings between the plurality of strips can be sized and configured to receive the anchoring element 122. The openings can be larger than shown in FIG. 10. In other embodiments, the support strips can form a weave in which the strips are arranged to extend at diagonal angles (optionally, 45 degrees). The diagonally arranged support strips can crisscross at approximately right angles relative to one another, but in an overall diagonal or approximately 45 degree orientation relative to a vertical and/or a horizontal direction.

Figure 9:
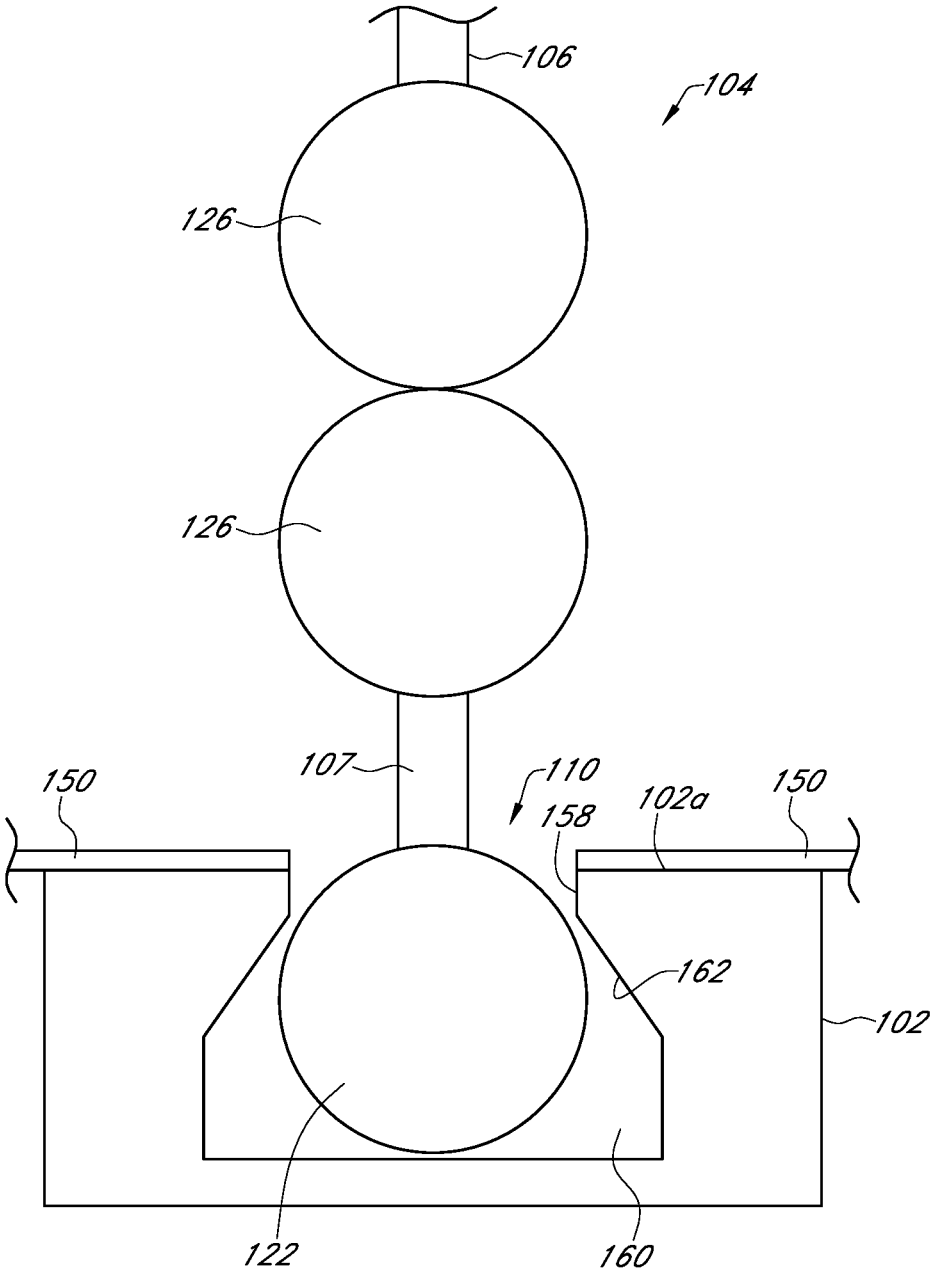
FIG. 9 is a section view of a portion of the embodiment of the massage device shown in FIG. 1.

FIG. 9 is a section view of a portion of the embodiment of the support member 102 and an example of a support element 110. As shown, any embodiments of the massage devices 100 disclosed herein can have any of the support element 110 embodiments described herein, including the receptacle embodiment 110 illustrated in FIG. 9 and any of the embodiments described below. In some embodiments, the support element 110 can have an opening 158 that can extend through a first main surface 102*a* of the support member 102. In any embodiments, the opening 158 can have a square shape, a rectangular shape, a round shape, or other suitable or desired shape. In some embodiments, the opening 158 can be sized and configured to provide an interference fit or a close fit relative to the anchoring element 122 or otherwise be sized and configured to bias the anchoring element 122 to remain in a cavity or internal space 160 within the support element 110 after the anchoring element 122 has been inserted into or advanced past the opening 152 into the space 160. This can prevent the inadvertent removal or decoupling of the anchoring element 122 from the receptacle 160 during use of the massage device 100. For example, in some embodiments wherein the support member 102 comprises a flexible material such as foam, rubber, or otherwise, the opening 158 can be smaller than a size or diameter of the anchoring member 126 such that a user must force the anchoring member 126 through the opening 158 in order to insert the anchoring member 126 into the space 160 of the support element 110. Additionally, in any embodiments, an angled or beveled surface 162 can provide additional support and rigidity to the support element 110 and also help align the anchoring member 126 with a middle or center portion of the support element 110 and/or bias the anchoring member 126 toward a center or middle portion of the support element 110. In any embodiments, the support member 102 can be made from or comprise a flexible material such as foam, including without limitation ethylene-vinyl acetate, polystyrene, and/or any other suitable foam material, rubber, or otherwise in any embodiments disclosed herein.

Any embodiments of the massage devices or components thereof disclosed herein can have any of the features, components, and/or other details of any of the other massage device embodiments or components thereof disclosed herein, including the cover or cover member embodiments and components thereof recited in the claims, to form additional embodiments having any combination of any of the features disclosed herein.

While certain embodiments have been described, these embodiments have been presented by way of example only, and are not intended to limit the scope of protection. Indeed, the novel methods and systems described herein may be embodied in a variety of other forms. Furthermore, various omissions, substitutions and changes in the form of the methods and systems described herein may be made. Those skilled in the art will appreciate that in some embodiments, the actual steps taken in the processes illustrated and/or disclosed may differ from those shown in the Figures. Depending on the embodiment, certain of the steps described above may be removed, others may be added. Accordingly, the scope of the present disclosure is intended to be defined only by reference to the claims of the utility application. The accompanying claims and their equivalents are intended to cover such forms or modifications as would fall within the scope and spirit of the protection. Furthermore, the features and attributes of the specific embodiments disclosed above may be combined in different ways to form additional embodiments, all of which fall within the scope of the present disclosure. Although the present disclosure provides certain embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims or claims that will be added in the future.

Accordingly, although the present disclosure includes certain embodiments, examples and applications, it will be understood by those skilled in the art that the present disclosure extends beyond the specifically disclosed embodiments to other alternative embodiments and/or uses and obvious modifications and equivalents thereof, including embodiments which do not provide all of the features and advantages set forth herein. Accordingly, the scope of the present disclosure is not intended to be limited by the specific disclosures of preferred embodiments herein, and may be defined by claims as presented herein or as presented in the future. Finally, as used herein and unless otherwise stated, the term approximately is meant to represent a range of +/−10% of the stated value.

What is claimed is:

1. A massage device, comprising:

a base portion having a first main surface;

a plurality of support elements coupled with the base portion or integral with the base portion; and a massage member comprising at least one massage element coupled or integrally formed therewith;

wherein:

the plurality of support elements are arranged in a grid pattern about the first main surface of the base portion;

an end portion of the massage member is configured to be removably supported by any of the plurality of support elements so that the end portion of the massage member is free to rotate in a plurality of angular directions relative to the support element that the end portion of the massage member is supported by; and the device is configured such that a user can rotate the massage member in the plurality of angular directions relative to the support element that the end portion of the massage member is supported by to force the massage member against a portion of the user's body to massage a portion of the user's body with the device.

2. The massage device of claim 1, wherein the plurality of support elements are positioned in a grid arrangement about the base portion comprising two or more rows and two or more columns of support elements.

3. The massage device of claim 1, wherein the plurality of support elements are each configured to bias the end portion of the massage member to remain coupled with the selected receiving element.

4. The massage device of claim 1, wherein the plurality of support elements have a main cavity portion and a constricted portion, wherein the constricted portion is configured to bias the end portion of the massage member to remain positioned within the main cavity portion.

5. The massage device of claim 1, wherein the device is configured such that the massage member can be rotated within the support element within a predetermined range.

6. The massage device of claim 1, wherein the massage member comprises a plurality of spherically shaped massage elements arranged about a length of the massage member.

7. The massage device of claim 1, wherein the end portion of the massage member comprises a spherically shaped end portion configured to be selectively supported by any one of the plurality of support elements.

8. The massage device of claim 1, wherein the support elements are configured to extend through the first main surface into a cavity portion of the base member in an operable state.

9. The massage device of claim 1, wherein the end portion of the massage member is configured to be removably supported by any of the plurality of support elements so that the massage member can be selectively supported and removed from any of the plurality of support elements without a use of any tools or fasteners.

10. The massage device of claim 1, wherein the device is configured such that the end portion of the massage member is coupleable with any of the support elements by only axially advancing the end portion into a desired support element.

11. The massage device of claim 1, wherein the support elements are enclosures having sides and a closed end portion.

12. The massage device of claim 11, wherein the support elements are each configured to receive and support the end portion of the massage member without the use of any fasteners.

13. The massage device of claim 1, wherein an opening to the support element has a smaller cross-sectional size as compared to any other portion of the support element.

14. The massage device of claim 1, wherein the base portion is configured to be strapped to a back portion of a chair.

15. A massage device, comprising:

a seat having a support portion having a first main surface and comprising a plurality of support elements, each support element having an opening that extends through the first main surface of the support portion; and a massage member comprising one or more massage elements positioned about a length of the massage member;

wherein:

the plurality of support elements are arranged in an array about the first main surface of the support portion;

an end portion of the massage member is configured to be removably supported by any of the plurality of support elements so that the end portion of the massage member is free to rotate in a plurality of angular directions relative to the support element that the end portion of the massage member is supported by; and the massage device is configured such that a user can rotate the massage member about an end portion of the massage member supported by the desired support element so as to force the massage member against a surface of the user's body, thereby effecting a massaging of a portion of the user's body.

16. A method of massaging one's own body with a massage device, comprising:

positioning a base portion so that a first surface of the base portion is in a vertical orientation;

inserting a first end portion of a substantially rigid massage member into a first support element of a plurality of support elements formed in the base portion, each support element being configured to support an end portion of the massage member;

rotating the massage member about the first end portion of the massage member and the first support element by moving a distal portion of the massage member in any direction normal to a longitudinal axis of the massage member, thereby forcing a portion of the massage member against a first portion of the user's body so that at least a portion of the massage member exerts a force on the first portion of the user's body to effect a massaging of the first portion of the user's body;

removing the first end portion of the massage member from the first support element;

inserting the first end portion of the massage member into a second support element of the plurality of support elements formed in the base portion;

rotating the massage member about the first end portion of the massage member and the second support element by moving a distal portion of the massage member in any direction normal to the longitudinal axis of the massage member, thereby forcing a portion of the massage member against a second portion of the user's body so that at least a portion of the massage member exerts a force on the second portion of the user's body to effect a massaging of the second portion of the user's body.

17. The method of claim 16, further comprising securing the base portion to the backrest of a chair and sitting in the chair.

* * * * *